US006145534A

United States Patent [19]

Romero

[11] Patent Number: 6,145,534

[45] Date of Patent: Nov. 14, 2000

[54] SCALD GUARD

[76] Inventor: Shawna Romero, 13484 Cherry Way, Thornton, Colo. 80241

[21] Appl. No.: 09/488,930

[22] Filed: Jan. 21, 2000

[51] Int. Cl.[7] ..... F16L 35/00

[52] U.S. Cl. ..... 137/382; 137/377; 16/277

[58] Field of Search ..... 137/377, 382; 16/277

[56] References Cited

U.S. PATENT DOCUMENTS

| | | | |
|---|---|---|---|
| 2,605,925 | 8/1952 | Morin | 16/277 |
| 3,201,820 | 8/1965 | Desrosiers | 16/277 |
| 3,397,422 | 8/1968 | Youngdale | 16/277 |
| 3,696,964 | 10/1972 | Deakin | 220/728 |
| 3,722,533 | 3/1973 | Connolly | 137/382 |
| 3,950,818 | 4/1976 | Holmes | 16/277 |
| 4,301,828 | 11/1981 | Martin, Jr. | 137/381 |
| 4,539,727 | 9/1985 | Mautner et al. | 16/285 |
| 4,678,003 | 7/1987 | Griffin | 137/382 |
| 5,027,626 | 7/1991 | Appelbaum | 70/164 |
| 5,092,359 | 3/1992 | Wirth et al. | 137/382 |
| 5,263,853 | 11/1993 | Pall | 137/382 |
| 5,588,316 | 12/1996 | Jones | 70/178 |
| 5,590,682 | 1/1997 | Fischer | 137/382 |

*Primary Examiner*—A. Michael Chambers
*Assistant Examiner*—Thomas L. McShane
*Attorney, Agent, or Firm*—Patent & Trademark Services; Thomas Zack; Joseph H. McGlynn

[57] ABSTRACT

A valve guard for a water faucet with a manually operated control valve. The guard has two substantially identical sections that when joined together in a closed position form a generally spherical surface with a lower cut off opening portion. A spring hinge joins the sections together at facing side edges to normally maintain the sections together in a closed position. A child has insufficient hand strength to pry the two joined sections apart while an adult may easy separate them. The guard is placed over the valve to be controlled with the opened lower portion first. Due to the exposed spherical shape of the closed guard enclosure and the flat bottom opening edge, the guard is difficult for small hands to grasp and when touched may freely rotate about the enclosed valve. The guard is sized relative to the valve structure to be protected. Thus, it may be fitted over the hot water control valve of a two control valve faucet or over the one control valve of a single control valve lever. The lifting of the in place closed guard valve structure can be prevented by selecting a lower opening size that is smaller than the lateral size of the enclosed covered valve.

5 Claims, 2 Drawing Sheets

SCALD GUARD

BACKGROUND OF THE INVENTION

This invention relates to a guard used over an existing faucet valve to prevent a child from changing the water input setting when in place.

Persons, especially small children, may for some reason change the proper initial water faucet or valve setting resulting in more hot water entering a bathing chamber to burn the user. To protect against disasters devices have been invented that prevent the changing of the water valve setting after it has been initially properly set. One such invention can be locked to prevent the rotation of valve by using an axial extending pin attachable to the rotatable valve. A covering cap goes over the pin's end and allows the cap to freely rotate and has a lock to prevent the cover from being removed from the cap from the pin. Another invention employs an enclosure for a valve handle formed of two enclosure halves which are hinged together to form a clamshell enclosure for the valve handle. A hasp and lock may be used to prevent the enclosure from being removed. With another invention, two locking devices are inserted over valves handle. Two handle enclosing components have connecting rods that can be locked to together by a locking block.

Still another invention is a water faucet rotation prevention device and includes an upper portion, a lower portion, pivoting apparatus and maintaining includes an upper portion, a lower portion, pivoting apparatus and maintaining apparatus. The upper portion receives a part of a pair of spaced apart water faucets and the lower pivotally mounted portion receives a remaining part of the pair of water faucets.

DESCRIPTION OF THE PRIOR ART

Devices that can be used to prevent the actuation of a preset water faucet handle are known. For example, in the U.S. Pat. No. 5,027,626 to Appelbaum apparatus there is disclosed a rotatable valve having an axial extending pin attachable to the rotatable valve. A covering cap goes over the pin's end and allows the cap to freely rotate and there is a lock to prevent the cover from being removed from the cap from the pin.

U.S. Pat. No. 5,092,359 to Wirth et al. discloses an enclosure for a valve handle formed of two enclosure halves which are hinged together to form a clamshell enclosure for the valve handle. A hasp and lock may be used to prevent the enclosure from being removed.

U.S. Pat. No. 5,588,316 to Jones discloses two locking devices inserted over valves handle. Two handle enclosing components have connecting rods that can be locked to together by a locking block.

U.S. Pat. No. 5,590,682 to Fischer discloses a water faucet rotation prevention device which includes an upper portion, a lower portion, pivoting apparatus and prevention device which includes an upper portion, a lower portion, pivoting apparatus and maintaining apparatus. The upper portion receives a part of a pair of spaced apart water faucets and the lower pivotally mounted portion receives a remaining part of the pair of water faucets.

In the present invention includes two pivotally connected hollow substantially identical enclosures that can be placed over the valve to be controlled. Each of the enclosures are normally biased together to a closed position and each has a lower opened base portion all as will be detailed in the specification that follows hereafter.

SUMMARY OF THE INVENTION

This invention relates to valve guard which can be placed over a valve or faucet.

It is the primary object of the present invention to provide for an improved valve guard.

Another object is to provide for such a guard that consists of two substantially identical hemispherical shaped hollow members having a common lower open base.

These and other objects and advantages of the present invention will

These and other objects and advantages of the present invention will become apparent to readers from a consideration of the ensuing description and the accompanying drawings.

DESCRIPTION OF THE PREFERRED EMBODIMENT

Figure 1:
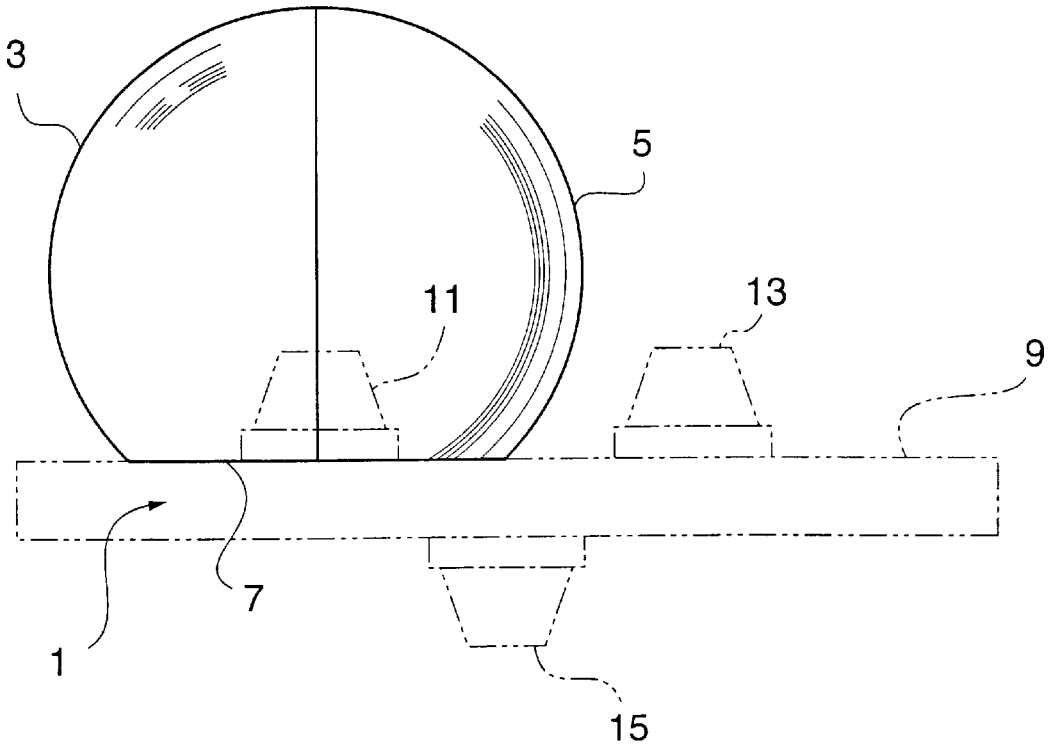
FIG. 1 is a front view of the present invention in a closed position mounted over a water valve.

FIG. 1 is a front view of the present valve guard invention in a closed position mounted over a water valve 1, shown in dotted line format. The guard has two generally hemispherically shaped identical sections 3 and 5 each of which has an aligned common lower cut off base opening 7. When these two aligned openings 7 are joined together they form a single lower base opening. The two identical shaped base openings 7 extends across the lower portions of both sections 3 and 5, and in this view are shown as a straight flat line such that they lie flush against a lower supporting flat valve or water container surface 9. they lie flush against a lower supporting flat valve or water container surface 9. Normally the supporting surface 9 is below the two conventional water control valves 11 and 13 (shown in dotted line format) used to manually control, respectively, the input (11) of hot or cold (13) water. The control valves are just above the lower common mixing chamber and lower discharge opening 15. Only the hot water input handle 11 is enclosed by the sections 3 and 5 with the cold water input handle 13 being outside of the sections. By using a flat interface edge to define the two base openings 7 and engaged the base supporting surface 9 the two joined hemispheres 3 and 5 may freely rotated around the hot water control valve 11 in either direction as shown by the arrows. This insures that the in place sections 3 and 5 can not easily be moved by a small child from their placement over the hot water input valves to allow the child to change the previously valve setting. The lower straight edges of the opened flat base 7 additionally permits the easy placement from above by an adult of the two joined sections over the valve 11 with the side edges of the formed base opening preventing much lateral shifting on surface 9 of the sections 3 and 5 to the sides of the enclosed valve.

The two guard edge joined sections 3 and 5 can be made of a hard plastic material like ABS (Acrylonitrile-butadiene-styrene) plastic. These sections may be either color coordinated to match the sink or tub surfaces on which used or may be made of a clear transparent material. In any event, each of the two may be made of a clear transparent material. In any event, each of the two sectional formed base openings 7 are designed to be sufficiently large to permit the placement of either of the two joined sections 3 and 5 over the valve at the same time or, if desired, their openings may be sized such that one first opening section 7 may be placed over the valve with the other second section opening being moved together towards the first section opening as the sections 3 and 5 are brought together. The large outside round spherical shape of the two joined guard sections prevents small hands from easily grabbing and vertically displacing the joined sections once placed in position over the hot water valve. This construction insures the proper hot water valve setting will not be tampered with by a young user.

Figure 2:
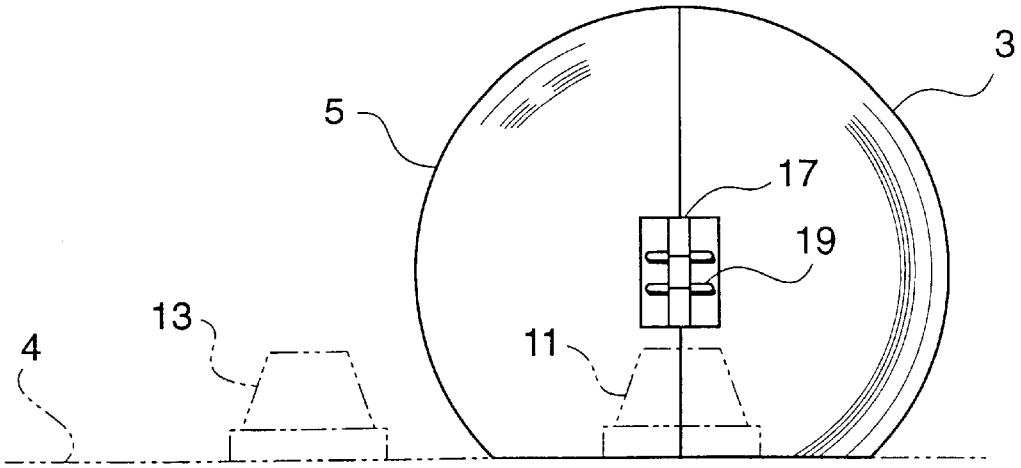
FIG. 2 is a back view of the invention of FIG. 1 in a closed position showing the hinged connection that joins two sections.

FIG. 2 is a back view of the invention of FIG. 1 in a closed position showing the hinged connection 17 that joins the two sections 3 and 5 together along there facing edges. In this view the positions of the sections and two valves 11 and 13 are reversed from those shown in FIG. 1 and the structure of the lower water discharge opening structure 15 has been omitted. The conventional hinge connection 17 joins the two sections together and spans the opening formed between their common facing edges. Two conventional spaced biasing springs 19 operatively associated with the hinge connection 17 normally bias the two joined sections to a closed position such as is shown in FIGS. 1 and 2. The strength of the springs 19 is specifically chosen to make it very unlikely or impossible for a small user to pry apart the two joined in place sections 3 and 5. However, an adult may easily pivot the two sections at the hinge to move them apart to an opened position as shown in the next figure (FIG. 3).

Figure 3:
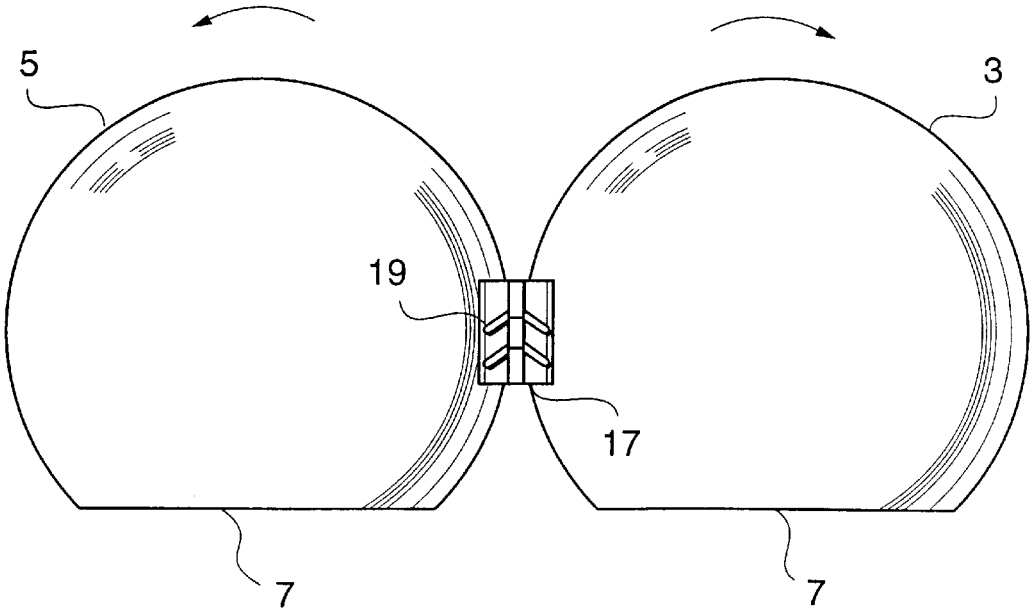
FIG. 3 is a back view of the two sections in an opened position.

FIG. 3 is a back view of the two joined and hollow hemispherically shaped sections 3 and 5 in an opened position. The valves and their supporting sink or tub surfaces have been omitted from this view. An adult user simply takes each of the two sections 3 and 5, one hand on each section, and spreads them apart against the biasing action of the hinge springs 19. When in this opened position a user may fit one of the lower base opening 7 (e.g., section 3) over the hot water control valve 11 to be protected and then allow the other section (5) with the other identical section opening 7 to engage the first section along a flush joining section edge.

Figure 4:
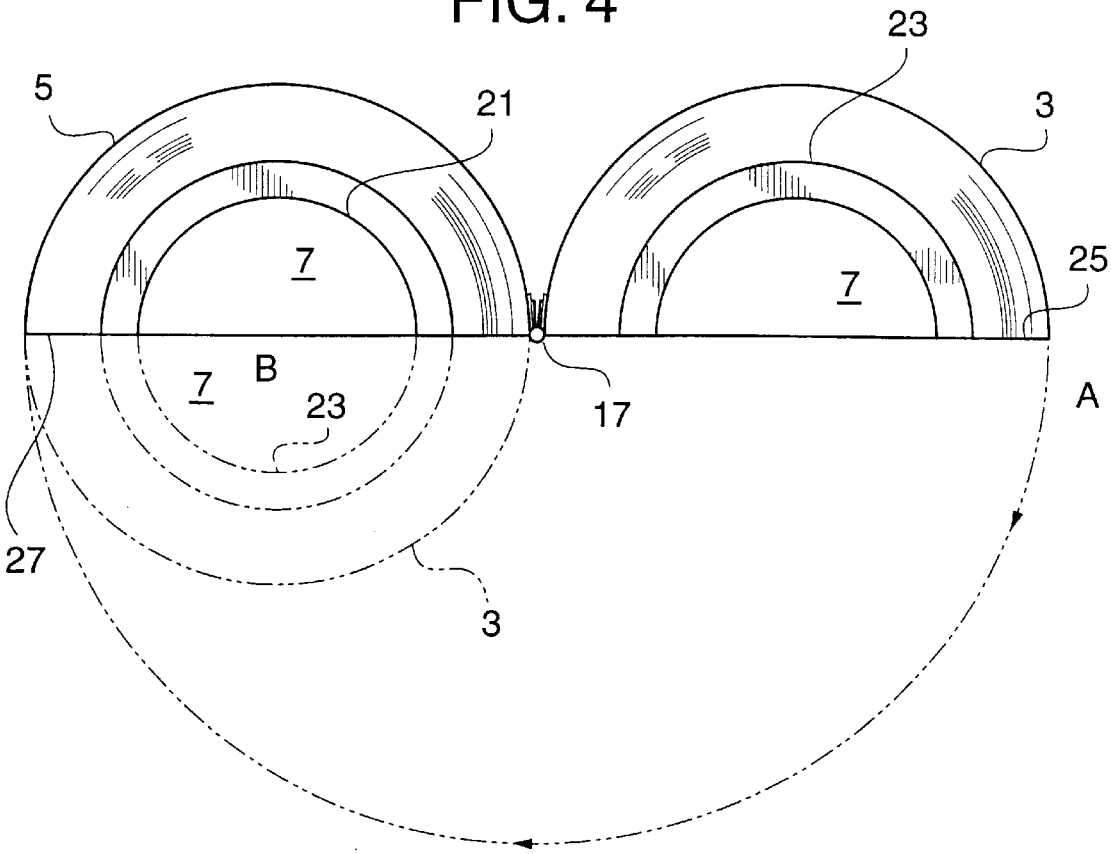
FIG. 4 is a bottom view of the two sections in an opened position.

FIG. 4 is a bottom view of the two sections 3 and 5 in an opened position. The two identical hemispheric shaped openings 7 are each defined by the section edges 21 and 23 in sections 5 and 3, respectively. If section 3 is rotated about hinge 17 in the direction of arrow A the flat edge 25 of section 3 will engage the flat edge 27 of section 5. When this happens the two sections are joined together as in FIGS. 1 and 2, with the two facing curved edges 21 and 23 defining a circle B, shown in dotted line format, having a diameter less than the outer surface diameter of the major hollow sphere formed by the joined sections 3 and 5. For surface diameter of the major hollow sphere formed by the joined sections 3 and 5. For example, in one embodiment the outer surface diameter of the major sphere was 11 inches while the diameter of the inner circle defined by the joined opening edges 21 and 23 was about 7 inches. It is important to note that the diameter of the formed lower inner opening base circle B can be selected such that it may not allow the displacement of the in-place closed guard from the hot water control valve of the faucet. If desired, the opening for the base diameter can be small enough that when placed over a particular sized faucet it may not be lifted off the faucet without first opening the two joined sections.

Clearly, the invention is not restricted to use valves using only dual valves or faucet handles. When the faucet has a single control lever arm or valve, the knob is lift or push up to turn the flow of water on. The invention is then put in place over the single control of the faucet with the proper water flowing valve setting. When so placed over the single control handle, a small child is unable lift the guard and reset the faucet's control to turn on additional hot water due to the guard's sphere shape and its freely spin seating on the faucet base surface on which placed. Additionally, the size of the spherical shape of the guard is selected to be large enough such that small hands may not readily lift the valve guard from the faucet.

The principles behind the operation of this invention could conceivably be used with any type of manually operated valve, in addition to water control valves, used with any type of manually operated valve, in addition to water control valves, where safety for small users is a consideration.

Although the preferred embodiment of the present invention and the method of using the same has been described in the foregoing specification with considerable details, it is to be understood that modifications may be made to the invention which do not exceed the scope of the appended claims and modified forms of the present invention done by others skilled in the art to which the invention pertains will be considered infringements of this invention when those modified forms fall within the claimed scope of this invention.

What I claim as my invention is:

1. A combined water faucet and valve guard comprising:

a water faucet having at least hand operated control valve;

a first guard section and a second guard section, said first and second guard sections each being substantially identical in shape and having a formed hollow interior when joined together, said first guard section and said second guard sections being pivotally joined together at a facing side; and each of said first and second guard sections having a lower cut off portion that forms a lower guard opening, said guard opening being adapted to fit over said water faucet control valve and be freely mounted to spin around the control valve.

2. The combination as claimed in claim 1, wherein each of said first and second guard sections when joined together are substantially hemispherically shaped and form a generally spherical surface with a lower cut off opened portion when joined together in a closed position.

3. The combination as claimed in claim 2, wherein said first section and said second guard section are pivotally joined together by a hinge connection that is normally spring biased to force the sections together to the closed position.

4. The combination as claimed in claim 3, wherein the cut off portions of said first and second sections form a generally circular opening when the two sections are in a closed position.

5. The combination as claimed in claim 4, wherein said guard sections are each made of a hard plastic material.

* * * * *